US009659698B2

(12) United States Patent
Schmitz et al.

(10) Patent No.: US 9,659,698 B2
(45) Date of Patent: May 23, 2017

(54) ELECTROMECHANICAL SOLENOID HAVING A POLE PIECE ALIGNMENT MEMBER

(71) Applicants: Matthew Schmitz, Milwaukee, WI (US); Austin Schmitt, Menomonee Falls, WI (US); Kirt Stephens, New Berlin, WI (US); Kevin Rode, Brookfield, WI (US)

(72) Inventors: Matthew Schmitz, Milwaukee, WI (US); Austin Schmitt, Menomonee Falls, WI (US); Kirt Stephens, New Berlin, WI (US); Kevin Rode, Brookfield, WI (US)

(73) Assignee: HUSCO AUTOMOTIVE HOLDINGS LLC, Waukesha, WI (US)

( * ) Notice: Subject to any disclaimer, the term of this patent is extended or adjusted under 35 U.S.C. 154(b) by 21 days.

(21) Appl. No.: 14/284,595

(22) Filed: May 22, 2014

(65) Prior Publication Data

US 2015/0340144 A1 Nov. 26, 2015

(51) Int. Cl.
*H01F 7/16* (2006.01)
*H01F 5/02* (2006.01)

(52) U.S. Cl.
CPC ..... *H01F 7/1607* (2013.01); *H01F 5/02* (2013.01); *H01F 7/16* (2013.01); *H01F 7/1653* (2013.01); *H01F 2007/163* (2013.01); *Y10T 29/49073* (2015.01)

(58) Field of Classification Search
CPC ..... H01F 2007/163
See application file for complete search history.

(56) References Cited

U.S. PATENT DOCUMENTS

| | | | | |
|---|---|---|---|---|
| 4,100,519 | A | 7/1978 | Neff | |
| 4,217,568 | A | 8/1980 | Chiba et al. | |
| 4,493,474 | A * | 1/1985 | Ohyama | 251/129.01 |
| 5,464,041 | A | 11/1995 | Reincke | |
| 5,687,698 | A | 11/1997 | Mastro et al. | |
| 5,901,940 | A | 5/1999 | Hussey et al. | |
| 5,924,675 | A | 7/1999 | Hussey et al. | |
| 5,947,092 | A | 9/1999 | Hussey et al. | |
| 6,313,726 | B1 * | 11/2001 | Golovatai-Schmidt et al. | 335/220 |

(Continued)

FOREIGN PATENT DOCUMENTS

DE 102006015233 * 10/2007

OTHER PUBLICATIONS

Extended European Search Report, Appln. No. 15168614.4-1556; dated Oct. 22, 2015; 6 pages.

*Primary Examiner* — Mohamad A Musleh
(74) *Attorney, Agent, or Firm* — Quarles & Brady LLP

(57) ABSTRACT

An electromechanical solenoid has a solenoid assembly including a solenoid coil with a coil aperture formed therein. A pole piece assembly is positioned at least partially within the coil aperture, the pole piece assembly including a first pole piece and a second pole piece positioned at least partially within an hour-glass shaped alignment member. The first pole piece has a first bore and a first outer tapered surface extending away from the first bore, and the second pole piece has a second bore and a second outer tapered surface extending away from the second bore. An armature is moveable within the first bore and the second bore in response to a magnetic field produced by the solenoid coil.

31 Claims, 5 Drawing Sheets

(56) References Cited

U.S. PATENT DOCUMENTS

| | | | | |
|---|---|---|---|---|
| 6,955,336 | B2 * | 10/2005 | Bircann et al. | 251/129.15 |
| 7,007,925 | B2 | 3/2006 | Nordstrom et al. | |
| 8,350,652 | B2 * | 1/2013 | Hoppe et al. | 335/262 |
| 8,581,683 | B2 * | 11/2013 | Hoppe et al. | 335/262 |
| 2001/0033214 | A1 | 10/2001 | Bircann et al. | |
| 2004/0257185 | A1 * | 12/2004 | Telep | 335/220 |
| 2006/0027773 | A1 * | 2/2006 | Nordstrom et al. | 251/129.15 |
| 2007/0062591 | A1 * | 3/2007 | Armour | 137/625.65 |
| 2009/0039992 | A1 * | 2/2009 | Ryuen et al. | 335/255 |
| 2009/0256091 | A1 * | 10/2009 | Nordstrom et al. | 251/129.15 |
| 2011/0285484 | A1 * | 11/2011 | Hoppe et al. | 335/229 |

* cited by examiner

ELECTROMECHANICAL SOLENOID HAVING A POLE PIECE ALIGNMENT MEMBER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a solenoid, and more particularly to an electromechanical solenoid having an alignment member for alignment of two pole pieces between which an armature moves.

2. Description of the Related Art

An electromechanical solenoid is a device that converts electrical energy into linear motion. Solenoids are used in a vast array of applications due to their utility. For example, solenoids are commonly used to control mechanical devices, including valves. In this application, the solenoid is typically mechanically coupled to the valve, either a pneumatic or hydraulic valve, and the solenoid is used to actuate the valve.

Referring to FIG. 1, solenoid 30 includes an electromagnetic coil 32 wound around an annular bobbin 34. An induced magnetic circuit travels through pole pieces 36 and 38, and a moving armature 40. A ferromagnetic housing 42 completes the basic magnetic circuit.

A common arrangement for creating and maintaining alignment of components within a solenoid is through the use of a non-magnetic cup-like tube 44 as seen in FIGS. 1 and 2. There are several tube arrangements that can be either open or enclosed, but the fundamental purpose is the same. The tube 44 provides a uniform smooth surface 46 for the armature 40 to travel, thus reducing hysteresis in the force output of the solenoid 30. The tube 44 is typically made of a non-ferromagnetic material such as stainless steel or aluminum. It may also be post treated to improved durability from the armature traveling against its surface.

Referring to FIG. 2, this common solenoid arrangement results in losses in the magnetic circuit due to air gaps, such as 48 and 50. These losses due to the air gaps are not desirable because they take away force from the solenoid output. One of the primary losses in current solenoid arrangements is due to the non-magnetic cup-like tube 44, which creates an additional air gap between the armature 40 and the pole piece 36. However, elimination of the tube 44 results in uncontrolled axial alignment of the armature 40 within the solenoid, which creates hysteresis in the force output of the solenoid.

Thus, maintaining alignment of pole pieces and reducing non-working air gaps becomes an important element in the improved operation of an electromechanical solenoid.

SUMMARY OF THE INVENTION

The disclosed invention reduces the losses in a solenoid magnetic circuit by eliminating non-working air gaps. An hour-glass shaped alignment member provides centering and alignment for a first pole piece and a second pole piece. With the first pole piece and the second pole piece properly aligned, a solenoid plunger is enabled to freely slide within bores of the first pole piece and the second pole piece, thereby eliminating the need for a cup-like armature sleeve used in previous solenoids, and avoiding non-working air gaps associated with the cup-like armature sleeve.

In accordance with an embodiment of the invention, an electromechanical solenoid comprises a solenoid assembly including a solenoid coil with a coil aperture formed therein. A pole piece assembly is positioned at least partially within the coil aperture, the pole piece assembly including a first pole piece and a second pole piece positioned at least partially within an alignment member. The first pole piece has a first bore and a first outer tapered surface extending away from the first bore, and the second pole piece has a second bore and a second outer tapered surface extending away from the second bore. An armature is moveable within the first bore and the second bore in response to a magnetic field produced by the solenoid coil.

In a preferred embodiment of the electromechanical solenoid, the solenoid actuator has a first pole piece with a tubular interior section that extends into one end of the coil aperture. A second pole piece has a tubular section that extends into another end of the coil aperture. The armature slides within the tubular interior section of the first pole piece and the tubular section second pole piece in response to a magnetic field produced by the solenoid coil. A housing, which encloses the first and second pole pieces and the coil, is secured to the valve body by crimped connection.

DETAILED DESCRIPTION OF THE INVENTION

Figure 1:
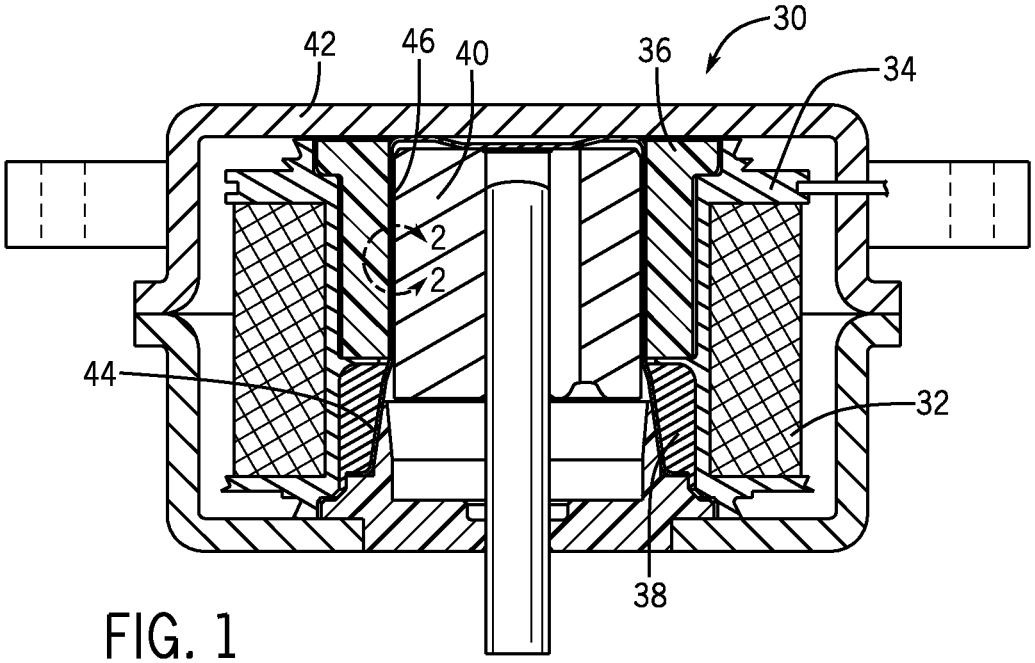
FIG. 1 PRIOR ART
FIG. 1 is a cross-sectional view of a prior art solenoid arrangement.
Figure 2:
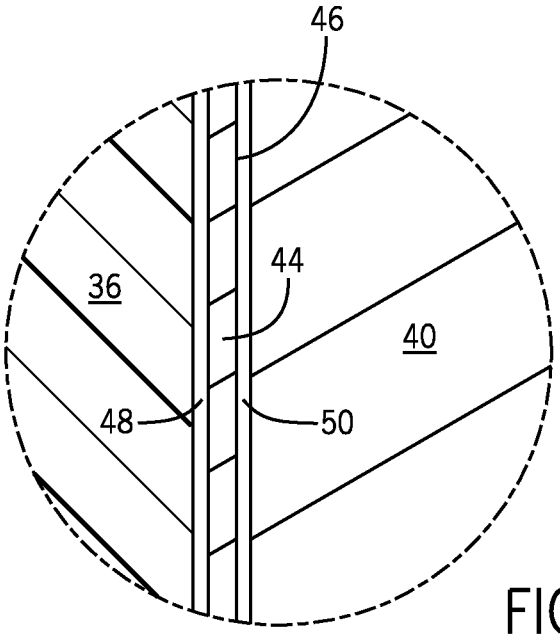
FIG. 2 PRIOR ART
FIG. 2 is a close-up view of a portion of a cup-like tube and associated air gaps created thereby as seen in FIG. 1.

Referring to FIGS. 3 through 6, an exemplary electromagnetic solenoid 60 including an actuator housing 62 and over mold 64 is shown. The electromagnetic solenoid 60 comprises a solenoid coil 66 in a non-magnetic bobbin 68, commonly made of plastic molded around the coil 66 to form a solenoid assembly 72. The solenoid coil 66 can be driven by a pulse width modulated (PWM) signal having a duty cycle that is varied in a conventional manner to vary the force output of the electromagnetic solenoid 60. The PWM signal can be applied to the electromagnetic solenoid 60 via a connector 74 formed in the over mold 64 and connected by wires (not shown) to the solenoid coil 58.

Referring now to FIGS. 5 through 8, the electromagnetic solenoid 60 further includes a pole piece assembly 76 positioned at least partially within a coil aperture 70 formed by the solenoid assembly 72. The pole piece assembly 76 comprises two magnetically conductive pole pieces 80 and 82 positioned at least partially within an alignment member 116, and a solenoid plunger 142 positioned at least partially within in the pole pieces 80 and 82. The first pole piece 80 includes a first open end 84 and a first closed end 86. The first pole piece 80 has a cylindrical bore 88 and a first outer tapered surface 92 tapering outward from the first open end 84 and extending away from the cylindrical bore 88 and forming a first ledge 90. The outer tapered surface 92 forms a frustoconical shape. An O-ring (not shown) may be included between the first pole piece 80 and the bobbin 68 or the housing 62 to provide a seal. The second pole piece 82 includes a second open end 94 and a second closed end 96. The second pole piece 82 also has a cylindrical bore 98 and a second outer tapered surface 102 tapering outward from the second open end 94 and extending away from the cylindrical bore 98 and having a frustoconical shape. A first aperture 104 at the second closed end 96 allows a tubular push member 106 to extend through the closed end 96 of the second pole piece 82. A second aperture 108 can also be included to allow air or a lubricant to flow into and out of the bores 88 and 98. In some embodiments, the second pole piece 82 can have a flange 112 that projects outwardly from the outer tapered surface 102. A second O-ring (not shown) may be included between the second pole piece 82 and the bobbin 68 to provide a seal.

In order to align the first pole piece 80 and the second pole piece 82, the outer tapered surface 92 of the first pole piece 80 and the outer tapered surface 102 of the second pole piece 82 are inserted into a similarly shaped alignment member 116. This arrangement allows the first pole piece 80 and the second pole piece 82 to generally face each other inside the alignment member 116. The open end 84 of the first pole piece 80 is spaced from the open end 94 of the second pole piece 82. A predefined space or gap 118 is created between the open end 84 of the first pole piece 80 and the open end 94 of the second pole piece 82 (see FIG. 6). The alignment member 116 can be made of stainless steel or other non-ferromagnetic materials such as aluminum.

Figure 9:
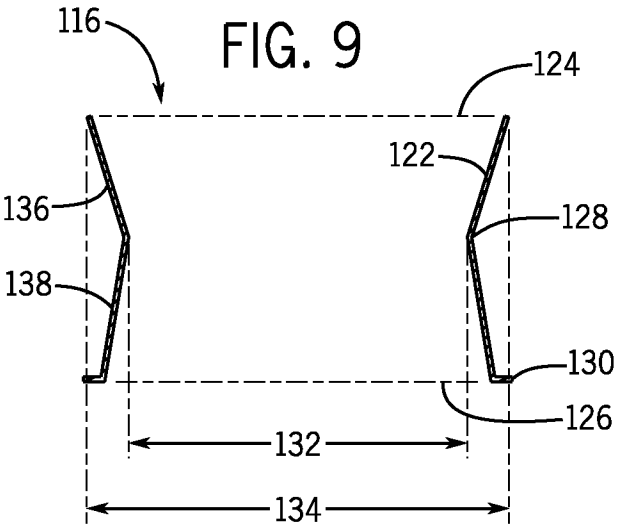
FIG. 9 is a cross-sectional view through an embodiment of an hour-glass shaped alignment member as shown in FIG. 8 according to embodiments of the invention.

An interior surface 122 of the alignment member 116 tapers inward from a first end 124 and a second end 126 to form a center portion 128, the alignment member 116 generally forming an hour glass shape. The second end 126 can have a flange 130 that projects outwardly from the second end 126. The center portion 128 has a center portion diameter 132 that is less than a diameter 134 at the first end 124 and the second end 126 (see FIG. 9). The interior surface 122 of the alignment member 116 serves to center and align the first pole piece 80 and the second pole piece 82 when inserted into the alignment member 116. Specifically, at least a portion of the outer tapered surface 92 of the first pole piece 80 is inserted into a first alignment portion 136 of the alignment member 116, and at least a portion of the outer tapered surface 102 of the second pole piece 82 is inserted into a second alignment portion 138 of the alignment member 116 (see FIG. 7). The resulting centering and aligning of the first pole piece 80 and the second pole piece 82 enables a solenoid plunger 142 to freely slide within the bores 88 and 98 of the first and second pole pieces 80 and 82, respectively, thereby eliminating the need for a cup-like armature sleeve used in previous solenoids. With the cup-like armature sleeve eliminated, the air gap due to the cup-like armature sleeve is also eliminated. The alignment member 116 maintains internal alignment of the first pole piece 80 and the second pole piece 82 while allowing the solenoid plunger 142 to move axially directly on the first and second pole pieces 80 and 82, which improves overall magnetic efficiency.

Figure 5:
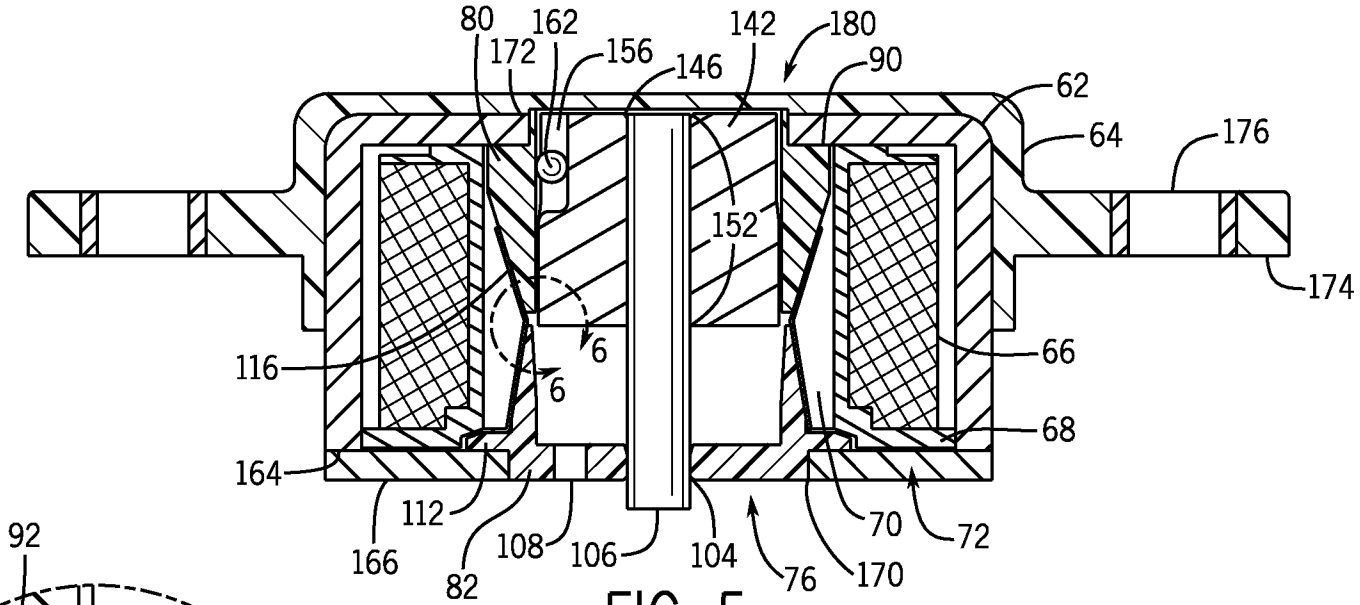
FIG. 5 is a cross-sectional view through an embodiment of an electromagnetic solenoid as shown in FIG. 3 according to embodiments of the invention.
Figure 6:
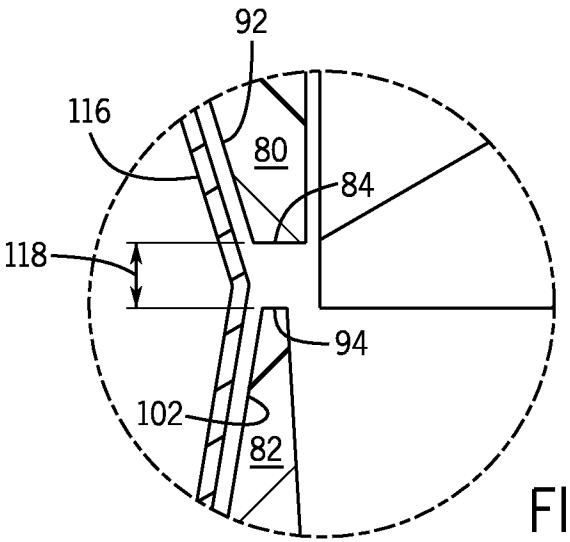
FIG. 6 is a close-up view of a portion of an alignment member and a gap created between a first pole piece and a second pole piece as seen in FIG. 5.
Figure 7:
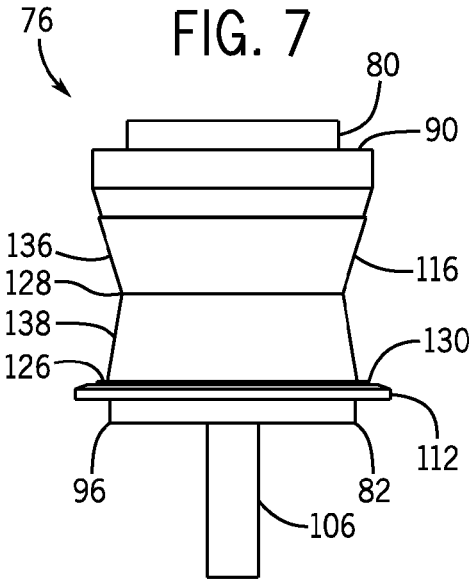
FIG. 7 is an isometric view of a pole piece assembly according to embodiments of the invention.
Figure 8:
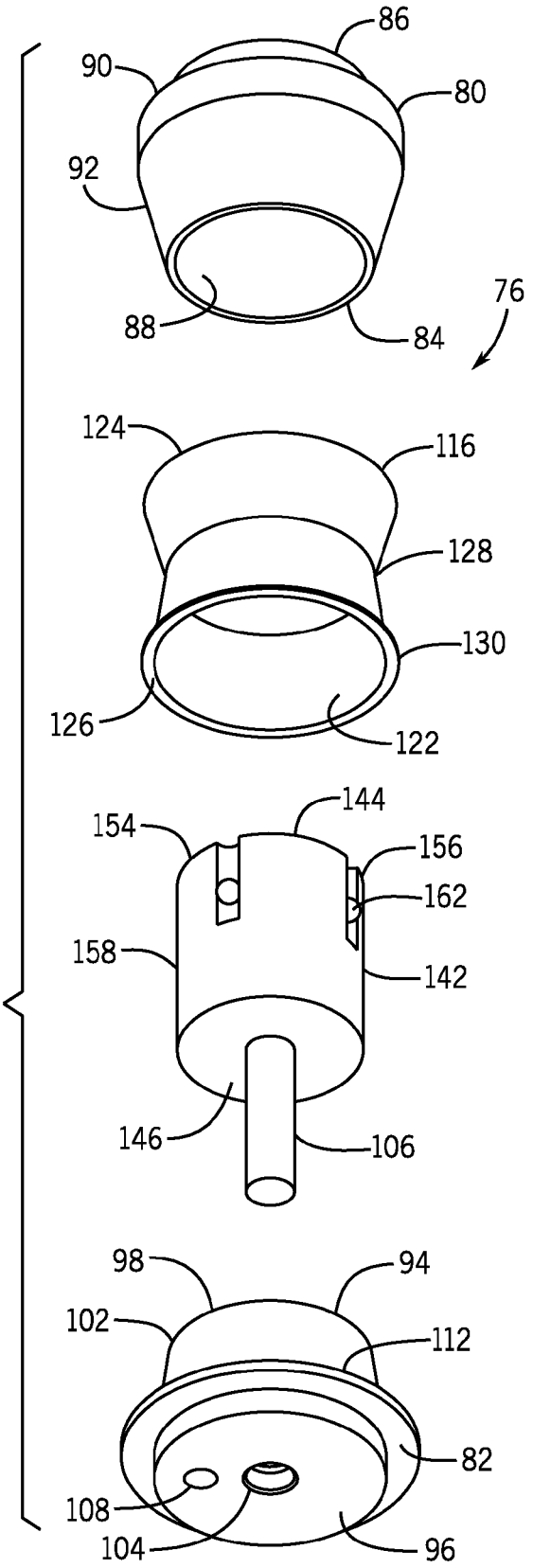
FIG. 8 is an exploded view of the pole piece assembly as shown in FIG. 7.

With reference to FIGS. 5 though 8, the solenoid plunger 142 of the electromagnetic solenoid 60 is slidably located at least partially within the bores 88 and 98 and includes an armature 144 of ferromagnetic material. The armature 144 has a longitudinal aperture 146 in which a tubular push member 106 is received. In some embodiments, one or both ends of the armature can be "ring staked" to the push member 106. As is known, ring staking involves forming indentations of the armature end surfaces at locations 152 which pushes that armature material around the aperture tightly against the push member 106. Other known methods of securing the push member 106 within the armature 144 are also contemplated. The push member 106 can be seen projecting outward from the second end 126 of the alignment member 116 and the closed end 96 of the second pole piece 82 (see FIG. 7).

The plunger 142 can further include a rolling bearing 154 integral with the armature 144. An axial force is applied to the plunger 142 by the magnetic flux at the first pole piece 80 and rolling bearing 154 helps to prevent binding of the armature 144 due to that axial force. The rolling bearing 154 can comprise a plurality of longitudinal slots 156 (five are shown) equidistantly spaced around the outer surface 158 of the armature 144. A separate chromium plated sphere 162 is located in each slot 156. Each sphere 162 projects from the respective slot into contact with the first pole piece 80 and are able to roll within the respective slot 156. Other forms and compositions of rollable elements, such as cylinders, may be used in place of the spheres 162.

Referring again to FIGS. 3 through 5, the electromagnetic solenoid 60 can be enclosed within the actuator housing 62 and over mold 64. The housing 62 can be made of a magnetically conductive metal and is shown extending around the solenoid assembly 72 and the pole piece assembly 76. An open end 164 of the actuator housing 62, adjacent the second pole piece 82, can be crimped or glued or welded or otherwise sealingly secured to a disk 166, for example, to close the open end 164. The second pole piece 82 can extend into a second pole piece aperture 170. The disk 166 provides structural support to hold the second pole piece 82 within the alignment member 116. At the opposite end, the actuator housing 62 can have a first pole piece aperture 172, allowing the first pole piece 80 to extend into the first pole piece aperture 172.

The alignment member 116 can be sized so as to provide a predetermined interference on one or both of the first pole piece 80 and the second pole piece 82. The interference can create a constant force on one or both of the first pole piece 80 and the second pole piece 82 to push the first pole piece 80 against the actuator housing 62, and/or to push the second pole piece 82 against the disk 166. This constant force helps to maintain contact and alignment between the first pole piece 80, the second pole piece 82, and the alignment member 116, which in turn helps to reduce the air gap between these components for further improved magnetic efficiency.

Over mold 64 can be applied over at least a portion of the exterior surface of the housing 62. The over mold 64 can include one or more tabs 174. Each tab 174 can include an aperture 176 to allow the electromagnetic solenoid 60 to be secured to a device (not shown) to be operated. As previously described, solenoids are used in a vast array of applications due to their ability to convert electrical energy into linear motion. For example, solenoids are commonly used to control valves or other mechanical devices to control the flow of fluids.

Figure 3:
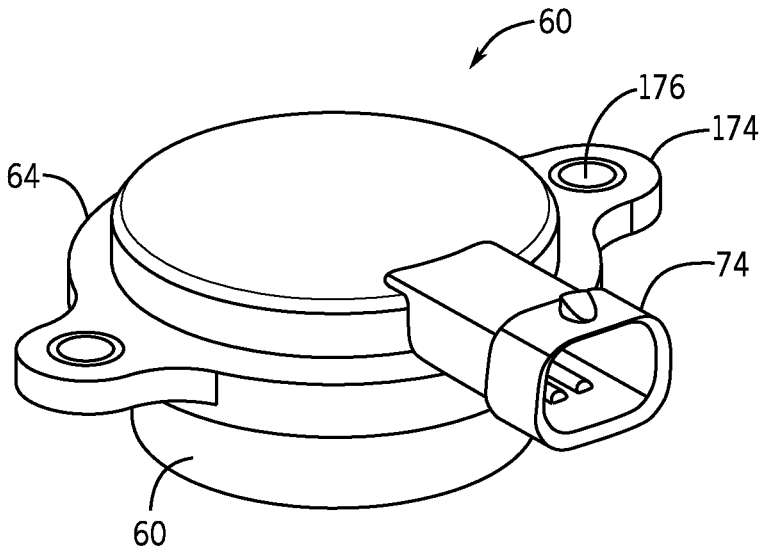
FIGS. 3 and 4 are isometric views of an electromagnetic solenoid according to embodiments of the invention.
Figure 4:
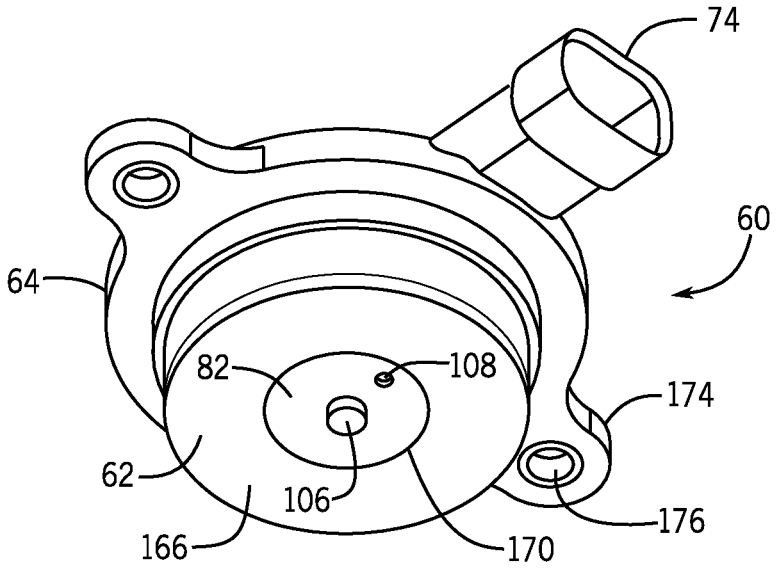

Still referring to FIGS. 3 through 5, the electromagnetic solenoid 60 can be fabricated by placing the solenoid coil 66 in a mold into which molten plastic for the bobbin 68 is injected to encapsulate the solenoid coil. After the solenoid assembly 72 has cured, the first pole piece 80 along with the alignment member 116 can be placed into the solenoid assembly 72. The armature 144 can then be placed in the bore 88 of the first pole piece 80. The second pole piece 82 can then be placed over the tubular push member 106 and into the solenoid assembly 72. The assembled solenoid assembly 72 and pole piece assembly 76 can then be inserted into the housing 62. Next the disk 166 can be positioned in the open end 164 of the housing 62 and secured in place. Over mold 64 can be applied over at least a portion of the exterior surface of the housing 62, thereby completing assembly of the electromagnetic solenoid 60.

Figure 10:
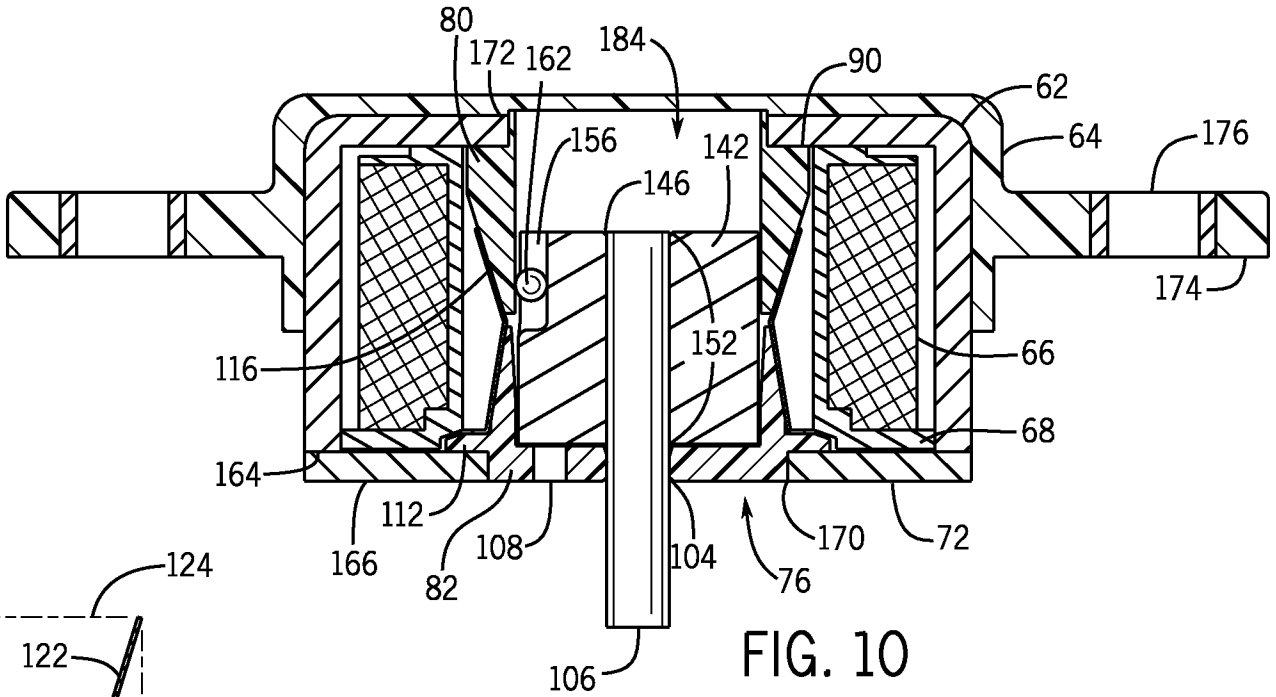
FIG. 10 is a cross-sectional view through the electromagnetic solenoid as shown in FIG. 5, except showing a solenoid plunger in an actuated position.

In use, application of a predetermined amount of electric current applied to the solenoid coil 66 produces a movement of the armature 144 and tubular push member 106. When no electric current is applied to the solenoid coil 66, the armature 144 and tubular push member 106 are typically biased in a first position 180 (see FIG. 5) due to a bias force applied to the tubular push member 106 by the device the electromagnetic solenoid is coupled to for mechanical actuation. When a predetermined amount of electric current is applied to the solenoid coil 66, the induced magnetic force moves the armature 144 and tubular push member 106 from the first position 180 to a second position 184 (see FIG. 10). The induced magnetic force and the resulting movement of the armature 144 and tubular push member 106 can be controlled by controlling the amount of current applied to the solenoid coil. This results in a controllable variable force applied by the tubular push member 106 to the device the electromagnetic solenoid is coupled to for mechanical actuation.

References herein to directional relationships and movement, such as upper and lower or up and down, refer to the relationship and movement of the components in the orientation illustrated in the drawings, which may not be the orientation of the components as attached to machinery.

The foregoing description was primarily directed to preferred embodiments of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. An electromechanical solenoid comprising:

a solenoid assembly including a solenoid coil with a coil aperture formed therein; and a pole piece assembly positioned at least partially within the coil aperture, the pole piece assembly including a first pole piece and a second pole piece positioned at least partially within an hour-glass shaped alignment member, the first pole piece having a first bore and a first outer tapered surface extending away from the first bore, the second pole piece having a second bore and a second outer tapered surface extending away from the second bore, and an armature moveable within the first bore and the second bore in response to a magnetic field produced by the solenoid coil.

2. The assembly according to claim 1, wherein the first pole piece has a first open end and a first closed end defining the first bore, and the second pole piece has a second open end and a second closed end defining the second bore.

3. The assembly according to claim 1, wherein the alignment member has an interior surface that tapers inward from a first end and a second end to form a center portion, the center portion having a center portion diameter that is less than a diameter at the first end and a diameter at the second end, the alignment member forming a first alignment portion for receipt of at least a portion of the first outer tapered surface, and a second alignment portion for receipt of at least a portion of the second outer tapered surface.

4. The assembly according to claim 3, wherein the first open end and the second open end face each other inside the alignment member when the first pole piece and the second pole piece are seated in the alignment member, the first open end and the second open end defining a gap between the first open end and the second open end.

5. The assembly according to claim 1, further including a housing, the housing having a first pole piece aperture at one end and a second pole piece aperture at an opposite end, the first pole piece extending into the first pole piece aperture and the second pole piece extending into the second pole piece aperture.

6. The assembly according to claim 5, wherein the alignment member provides a predetermined interference on one or both of the first pole piece and the second pole piece to create a force on one or both of the first pole piece and the second pole piece to push at least one of the firs-t pole piece and the second pole piece against the housing.

7. An assembly for use with a solenoid, the assembly comprising:

a first pole piece having a first end and defining a first bore, and a first outer surface tapering outward from the first end;

a second pole piece having a second end and defining a second bore, and a second outer surface tapering outward from the second end; and an alignment member having an interior surface that tapers inward from a member first end and a member second end to form a center portion, the center portion having a center portion diameter that is less than a diameter at the member first end and a diameter at the member second end, the alignment member forming a first alignment portion for receipt of at least a portion of the first outer surface of the first pole piece, and a second alignment portion for receipt of at least a portion of the second outer surface of the second pole piece.

8. The assembly according to claim 7, further including an armature moveable within the first bore and the second bore.

9. The assembly according to claim 8, wherein the armature includes a push member extending from and end of the armature.

10. The assembly according to claim 8, wherein the armature includes a roller bearing on an outer surface of the armature.

11. The assembly according to claim 10, wherein the roller bearing is at least partially in contact with the first bore.

12. The assembly according to claim 9, wherein the second pole piece further includes a first aperture at a second closed end to allow the tubular push member to extend through the second closed end.

13. The assembly according to claim 7, further including a coil having an aperture, the assembly being insertable into the aperture.

14. The assembly according to claim 13, wherein the armature is moveable within the first bore and the second bore in response to a magnetic field produced by the coil.

15. The assembly according to claim 7, wherein he first outer surface tapers outward from the first end and forms a first ledge.

16. The assembly according to claim 7, wherein the second outer surface tapers outward from the second end and forms a flange that projects outwardly from the second outer surface.

17. The assembly according to claim 7, wherein a gap is formed between the first end and the second end when the first pole piece and the second pole piece are seated in the alignment member.

18. The assembly according to claim 7, wherein the alignment member forms an hour glass shape.

19. The assembly according to claim 7, wherein the alignment member includes a flange that projects outwardly from the member second end.

20. The assembly according to claim 7, wherein the interior surface of the alignment member centers and aligns the first pole piece and the second pole piece when inserted into the alignment member.

21. An electromechanical solenoid comprising:

a housing;

a solenoid assembly positioned at least partially within the housing, the solenoid assembly including a solenoid coil in a non-magnetic bobbin, the solenoid assembly forming a coil aperture; and a pole piece assembly positioned at least partially within the coil aperture, the pole piece assembly including a first magnetically conductive pole piece and a second magnetically conductive pole piece positioned at least partially within an hour-glass shaped alignment member, the first pole piece having a first open end defining a first bore and a first outer surface extending away from the first bore, the second pole piece having a second open end defining a second bore and a second outer surface extending away from the second bore, and an armature moveable within the first bore and the second bore in response to a magnetic field produced by the solenoid coil.

22. The assembly according to claim 21, wherein the first open end and the second open end face each other inside the alignment member when the first pole piece and the second pole piece are seated in the alignment member, a gap being defined between the first open end and the second open end.

23. The assembly according to claim 21, further including an over mold applied over at least a portion of an exterior surface of the housing, the over mold having at least one tab, the tab including an aperture.

24. The assembly according to claim 21, wherein the alignment member is made of a non-ferromagnetic material.

25. The assembly according to claim 21, wherein the armature includes a tubular push member.

26. The assembly according to claim 25, wherein the alignment member has an interior surface that tapers inward from a first end and a second end to form a center portion, the center portion having a center portion diameter that is less than a diameter at the first end and a diameter at the second end, the alignment member forming a first alignment portion for receipt of at least a portion of the first outer surface, and a second alignment portion for receipt of at least a portion of the second outer surface.

27. The assembly according to claim 26, wherein the tubular push member projects outward from the second end.

28. The assembly according to claim 21, the housing having a first pole piece aperture at one end and a second pole piece aperture at an opposite end, the first pole piece extending into the first pole piece aperture and the second pole piece extending into the second pole piece aperture.

29. The assembly according to claim 28, wherein the alignment member provides a predetermined interference on one or both of the first pole piece and the second pole piece to create a force on one or both of the first pole piece and the second pole piece to push at least one of the first pole piece and the second pole piece against the housing.

30. A method for assembling an electromechanical solenoid, the method comprising the steps of:

providing a solenoid assembly including a solenoid coil, the solenoid assembly forming a coil aperture;

placing a first pole piece into the coil aperture, the first pole piece having a first open end and a first closed end defining a first bore, and a first outer surface tapering outward from the first open end;

placing an alignment member into the coil aperture and at least partially over the first outer surface, the alignment member having an interior surface that tapers inward from a member first end and a member second end to form a center portion, the alignment member forming a first alignment portion for receipt of at least a portion of the first outer surface, and a second alignment portion for receipt of at least a portion of a second outer surface of a second pole piece;

placing an armature into the coil aperture and into the alignment member such that the armature extends into the center portion; and placing the second pole piece into the coil aperture, the second pole piece having a second open end and a second closed end defining a second bore, and the second outer surface tapering outward from the second open end, the second outer surface extending at least partially into the second alignment portion.

31. The method according to claim 30, further including placing the solenoid assembly, including the first pole piece, the alignment member, the armature, and the second pole piece, into a housing.

* * * * *